US008125127B2

(12) United States Patent
Mo et al.

(10) Patent No.: US 8,125,127 B2
(45) Date of Patent: Feb. 28, 2012

(54) REFLECTIVE DEVICE FOR AREA LIGHTING USING NARROW BEAM LIGHT EMITTING DIODES

(76) Inventors: Anthony Mo, Mountain Lakes, NJ (US); Michael Palazzi, Mountain Lakes, NJ (US)

( * ) Notice: Subject to any disclaimer, the term of this patent is extended or adjusted under 35 U.S.C. 154(b) by 0 days.

(21) Appl. No.: 12/658,624

(22) Filed: Feb. 11, 2010

(65) Prior Publication Data

US 2010/0213835 A1 Aug. 26, 2010

Related U.S. Application Data

(60) Provisional application No. 61/207,377, filed on Feb. 11, 2009.

(51) Int. Cl.
*H01J 1/62* (2006.01)
*H01J 63/04* (2006.01)
*H01J 5/16* (2006.01)

(52) U.S. Cl. ..... 313/113; 313/110; 313/114; 313/483; 313/512; 313/116

(58) Field of Classification Search ..... None
See application file for complete search history.

(56) References Cited

U.S. PATENT DOCUMENTS

| | | | | |
|---|---|---|---|---|
| 4,591,960 | A | 5/1986 | Jones | |
| 6,283,612 | B1 | 9/2001 | Hunter | |
| 6,350,041 | B1 | 2/2002 | Tarsa et al. | |
| 6,742,907 | B2 | 6/2004 | Funamoto et al. | |
| 6,829,071 | B2 | 12/2004 | Allen et al. | |
| 6,840,654 | B2 | 1/2005 | Guerrieri et al. | |
| 6,890,642 | B2 | 5/2005 | Kaminsky et al. | |
| 7,049,746 | B2 | 5/2006 | Mano et al. | |
| 7,072,096 | B2 | 7/2006 | Holman et al. | |
| 7,080,924 | B2 * | 7/2006 | Tseng et al. | 362/241 |
| 7,278,775 | B2 | 10/2007 | Yeo et al. | |
| 7,329,029 | B2 | 2/2008 | Chaves et al. | |
| 7,352,339 | B2 | 4/2008 | Morgan | |
| 7,375,381 | B2 | 5/2008 | Shimizu et al. | |
| 7,377,679 | B2 | 5/2008 | Schultz | |
| 7,722,220 | B2 * | 5/2010 | Van De Ven | 362/294 |
| 7,922,359 | B2 * | 4/2011 | Chiang | 362/294 |
| 7,995,882 | B2 * | 8/2011 | Wanninger et al. | 385/31 |
| 2004/0095763 | A1 | 5/2004 | Guerrieri | |
| 2004/0105262 | A1 | 6/2004 | Tseng et al. | |
| 2005/0146890 | A1 | 7/2005 | Wu | |
| 2006/0001037 | A1 | 1/2006 | Schardt | |
| 2007/0279908 | A1 | 12/2007 | Alcelik | |

(Continued)

FOREIGN PATENT DOCUMENTS

EP 1 076 205 A1 2/2001

(Continued)

OTHER PUBLICATIONS

PCT Inter'l Search Report, Oct. 29, 2010, Mo, Anthony et al.

(Continued)

*Primary Examiner* — Natalie Walford
(74) *Attorney, Agent, or Firm* — Gearhart Law, LLC

(57) ABSTRACT

An article of manufacture, comprising: at least one point source of light which emits a light beam; and at least one reflective means for diffusing the light and/or converting the light to a different color range. The goal of this invention is to greatly increase the energy efficiency of area lighting by the use of highly efficient beams light sources.

19 Claims, 5 Drawing Sheets

U.S. PATENT DOCUMENTS

2008/0285301 A1 11/2008 Wanninger et al.

FOREIGN PATENT DOCUMENTS

EP 1 881 259 A1 1/2008
WO WO 01 40702 A1 6/2001
WO WO 2004 100213 A2 11/2004
WO WO 2007 130536 A2 11/2007
WO PCT/US2010/000385 8/2011

OTHER PUBLICATIONS

PCT Written Opinion, Oct. 29, 2010, Mo, Anthony et al.

* cited by examiner

REFLECTIVE DEVICE FOR AREA LIGHTING USING NARROW BEAM LIGHT EMITTING DIODES

CLAIM OF PRIORITY

This application claims priority to U.S. Provisional Application No. 61/207,377 filed Feb. 11, 2009, the contents of which are fully incorporated herein by reference.

FIELD OF THE INVENTION

The invention relates to illumination technology, in particular teaches how to diffuse light from a light beam.

BACKGROUND OF THE INVENTION

An article of manufacture is specified and is comprised of at least one point source of light which emits a light beam; and at least one reflective means for diffusing the light. This invention will enable the use of Light Emitting Diodes (LEDs), Organic Light Emitting Diodes (OLEDs), lasers, and other light beam technologies in providing area lighting.

DESCRIPTION OF THE RELATED ART

U.S. Pat. No. 7,377,679 teaches an illumination system including a light source, light guides coupled to the light source, each including an input surface and an output surface, emissive material positioned to receive light from at least one light guide, and an interference reflector positioned such that the emissive material is between the output surfaces of the light guides and the interference reflector is disclosed. The light source emits light having a first optical characteristic. The emissive material emits light having a second optical characteristic when illuminated with light having the first optical characteristic. The interference reflector substantially transmits light having the second optical characteristic and substantially reflects light having the first optical characteristic.

U.S. Pat. No. 7,375,381 teaches an LED illumination apparatus according to the present invention includes at least one connector and a lighting drive circuit. The connector is connected to an insertable and removable card-type LED illumination source, which includes multiple LEDs that have been mounted on one surface of a substrate. The lighting drive circuit is electrically connected to the card-type LED illumination source by way of the connector. The card-type LED illumination source preferably includes a metal base substrate and the multiple LEDs that have been mounted on one surface of the metal base substrate. The back surface of the metal base substrate, including no LEDs thereon, thermally contacts with a portion of the illumination apparatus. A feeder terminal to be electrically connected to the connector is provided on the surface of the metal base substrate on which the LEDs are provided.

U.S. Pat. No. 7,32,9029 teaches an optical device for coupling the luminous output of a light-emitting diode (LED) to a predominantly spherical pattern comprises a transfer section that receives the LED's light within it and an ejector positioned adjacent the transfer section to receive light from the transfer section and spread the light generally spherically. A base of the transfer section is optically aligned and/or coupled to the LED so that the LED's light enters the transfer section. The transfer section can comprises a compound elliptic concentrator operating via total internal reflection. The ejector section can have a variety of shapes, and can have diffusive features on its surface as well. The transfer section can in some implementations be polygonal, V-grooved, faceted and other configurations.

U.S. Pat. No. 7,278,775 teaches a light guide containing substantially aligned non-spherical particles provides more efficient control of light scattering. One or more regions containing ellipsoidal particles may be used and the particle sizes may vary between 2 and 100 microns in the smaller dimension. The light scattering regions may be substantially orthogonal in their axis of alignment. Alternatively, one or more asymmetrically scattering films can be used in combination with a backlight light guide and a reflector to produce an efficient backlight system. The light guides may be manufactured by embossing, stamping, or compression molding a light guide in a suitable light guide material containing asymmetric particles substantially aligned in one direction. The light scattering light guide or non-scattering light guide may be used with one or more light sources, collimating films or symmetric or asymmetric scattering films.

U.S. Pat. No. 7,0720,96 teaches a compact and efficient optical illumination system featuring planar multi-layered LED light source arrays concentrating their polarized or unpolarized output within a limited angular range. The optical system manipulates light emitted by a planar light emitters such as electrically-interconnected LED chips. Each light emitting region in the array is surrounded by reflecting sidewalls whose output is processed by elevated prismatic films, polarization converting films, or both. The optical interaction between light emitters, reflecting sidewalls, and the elevated prismatic films create overlapping virtual images between emitting regions that contribute to the greater optical uniformity. Practical illumination applications of such uniform light source arrays include compact LCD or DMD video image projectors, as well as general lighting, automotive lighting, and LCD backlighting.

U.S. Pat. No. 7,049,746 teaches a light-emitting unit, including LEDs mounted on both sides of a substrate, simulates a spherical light source. The LED on each side of the substrate is enclosed by a lens made of a material containing light-dispersing particles. The substrate is provided with a wiring pattern connected to the LEDs. Each of the light-dispersing lenses has a circular periphery which is adjacent to an edge of the substrate.

U.S. Pat. No. 6,890,642 teaches a transparent polymeric diffusion film exhibiting at least 50% transmissivity containing a thermoplastic polymeric material with internal microvoids and containing a plurality of complex lenses on a surface thereof. Such films are useful for diffusing light when it is desired to provide and even light distribution.

U.S. Pat. No. 6,840,654 teaches an LED light is set out where there is a conical reflecting chamber and a rear housing to accommodate a series of light emitting diodes, each diode residing in a chamber adapted therefore, said chambers being both wide and, and a circuit board contacts and pins for providing power thereto.

U.S. Pat. No. 6,829,071 teaches optical devices using reflective polarizers and, in particular, diffusely reflective polarizers are provided. Many of the optical devices utilize the diffusely reflecting and specularly transmitting properties of diffusely reflecting polarizers to enhance their optical characteristics. The optical devices include a lighting system which uses a reflector formed from a diffusely reflecting polarizer attached to a specular reflector. Another optical device is a display apparatus which uses a diffusely reflecting polarizer layer in combination with a turning lens which folds shallow angle light toward a light modulating layer. Other optical devices exploit the depolarizing characteristics of a diffusely reflecting polarizer when reflecting light. Still other optical devices use diffusely reflecting polarizers to recycle light and improve display illumination.

U.S. Pat. No. 6,742,907 teaches an illumination device is provided of the type arranged at the front which is of low power consumption and of high recognisability both when the illumination is turned on and when illumination is turned off. An illumination device arranged at the front face of an illuminated object has a light-guide plate forming a transparent flat plate shape and formed with point-form optical extraction structures on its surface or in a position facing this surface, and a light source arranged opposite and end face of this light-guide plate. The light source is for example a point light source. The optical extraction structures are for example pillar-shaped projections and these are arranged two-dimensionally. The function is provided that, when this illumination device is arranged at the front of the illuminated body, rays are projected on to the illuminated body and rays reflected by the illuminated body are transmitted with scarcely any dispersion. There is also provided a function of transmitting external light with scarcely any dispersion of rays reflected by the illuminated body when the illumination is not turned on. A point light source such as a light emitting diode (LED) or electric light bulb can be employed and low power consumption can easily be achieved.

U.S. Pat. No. 6,350,041 teaches a invention that provides a new solid state lamp emitting a light useful for room illumination and other applications. It comprises a solid state Light Source which transmits light through a Separator to a Disperser that disperses the light in a desired pattern and/or changes its color. In one embodiment, the Light Source is a blue emitting LED operating with current high enough for room illumination, the Separator is a light pipe or fiber optic device, and the Disperser disperses the light radially and converts some of the blue light to yellow to produce a white light mixture. The Separator spaces the Light Source a sufficient distance from the Disperser such that heat from the Light Source will not transfer to the Disperser when the Light Source is carrying elevated currents necessary for room illumination.

U.S. Pat. No. 6,283,612 teaches a light emitting diode light strip that uses a rigid hollow tube sized to accommodate a printed circuit board, which has a positive and negative bus extending the full length of the board. One or more resistors are in contact with the positive bus on one end and a series of light emitting diodes on the other. The diodes are mounted through holes in the board and the anode of the diode is in communication with a resistor while the cathode of the diode contacts an adjacent diode anode connecting them in linked series through traces on the bottom of the circuit board. The end cathode in each series, engages the negative bus forming a predetermined group of diodes electrically coupled to a single resistor on one end and the negative bus on the other. A pair of end caps encloses the tube and an electrical cable is connected through the caps to the busses on the circuit board. A power supply is in contact, through the electrical cable, with the board providing low voltage direct current power through the busses to a predetermined group of light emitting diodes, for illumination of the area surrounding the light strip.

US Patent Application No. 20060001037 teaches an illumination system including a light source, light guides coupled to the light source, each including an input surface and an output surface, emissive material positioned to receive light from at least one light guide, and a first interference reflector positioned between the emissive material and the output surfaces of the light guides is disclosed. The light source emits light having a first optical characteristic. The emissive material emits light having a second optical characteristic when illuminated with light having the first optical characteristic. The first interference reflector substantially transmits light having the first optical characteristic and substantially reflects light having the second optical characteristic.

US Patent Application No. 20050146890 teaches a vehicle light includes a base having an open side and a light-transmittable member attached to the open side of the base. The base includes an inner reflective surface that has a protrusion formed on a central portion thereof. The protrusion is covered with a reflective material. A circuit ring is mounted to the open side of the base. A plurality of spaced light-emitting diodes are mounted on the circuit ring. A light beam emitted by each light-emitting diode is incident on the protrusion to provide a convergent effect. The light beams are then reflected by the protrusion and the inner reflective surface to provide a large illumination area.

US Patent Application No. 20040095763 teaches an LED light that is set out where there is a conical reflecting chamber and a rear housing to accommodate a series of light emitting diodes, each diode residing in a chamber adapted therefore, said chambers being both wide and narrow, and a circuit board contacts and pins for providing power thereto.

European Patent Application No. EP 1881259 teaches a high power LED lamp comprises a container having a cavity to fill with a liquid, a light source module for providing a high power LED source light to penetrate through the liquid, and an axial thermal conductor having a first portion nearby the light source module and a second portion extending in the liquid along an axial direction of the cavity to far away from the light source module to evenly transfer heat from the light source module through the liquid to the container.

European Application No. EP1076205 teaches an edgelit display panel assembly comprising a frame supporting a light-diffusive plate and an electric light source or sources disposed along and closely adjacent to at least one edge of that plate for illuminating the whole plate and transmitting light through a major surface of the plate within the frame in use, wherein at least the said one edge of the plate has a light-receiving surface that is inclined and/or that lies within a recess formed in the edge of the plate. Preferably, the or each light source extends, in the plane of the plate, at least partly over the light-receiving surface. In an alternative assembly, the frame comprises a hollow, open channel for accommodating electric circuit components for the electric light source, and the channel is closed, in use, by a removable elongate fascia panel connected by an elongate magnet and which preferably also serves to frame (30) the edge of the image-supporting substrate.

International Patent Application No. 2007130536 teaches first, second and third lighting devices each comprise a thermal conduction element, solid state light emitters and a reflective element. In the second device, the conduction element defines an opening; and the emitters and reflective element are mounted on a first side of the conduction element. In the third device, the conduction element defines an opening; a first portion of a first side of the conduction element is in contact with a contact region of a construction surface; and the emitters and reflective element are mounted on the first side. A fourth device comprises a conduction element and emitters; a first portion of a first side of the conduction element is in contact with a contact region of a construction surface; the emitters are mounted on a second portion of the first side of the conduction element; and a second side of the conduction element is exposed to ambient air.

International Patent Application No. 2004100213 teaches a light source that comprises a light engine, a base, a power conversion circuit and an enclosure. The light engine comprises at least one LED disposed on a platform. The platform is adapted to directly mate with the base which a standard incandescent bulb light base. Phosphor receives the light generated by the at least one LED and converts it to visible light. The enclosure has a shape of a standard incandescent lamp.

International Patent Application No. 2001040702 teaches a new solid state lamp emitting a light useful for room illumination and other applications. It comprises a solid state Light Source which transmits light through a Separator to a Disperser that disperses the light in a desired pattern and/or changes its color. In one embodiment, the Light Source is a blue emitting LED operating with current high enough for room illumination, the Separator is a light pipe or fiber optic device, and the Disperser disperses the light radially and converts some of the blue light to yellow to produce a white light mixture. The Separator spaces the Light Source a sufficient distance from the Disperser such that heat from the Light Source will not transfer to the Disperser when the Light Source is carrying elevated currents necessary for room illumination.

None of the prior art teaches the invention of the current application.

SUMMARY OF THE INVENTION

The invention is an article of manufacture, having at least one point source of light which emits a light beam; and at least one reflective means for diffusing the light. Diffusion is achieved by the use of various reflective materials. The object of the invention is to provide area lighting that is more efficient than is currently available. Currently area lighting is generally provided by incandescent lights, fluorescent lights, and compact fluorescent lights. LED and OLED technologies are both more efficient at producing light than incandescent and fluorescent technologies but only produce beams of light, which is not suitable for area lighting. One advantage of the present invention is that it provides a means for diffusing light that can be kept and reused after the LED dims too much and needs to be replaced, Thus in one embodiment, the bulb casing is reusable. In other embodiments, the bulb casing is completely disposable.

DESCRIPTION OF THE PREFERRED EMBODIMENTS

Figure 1:
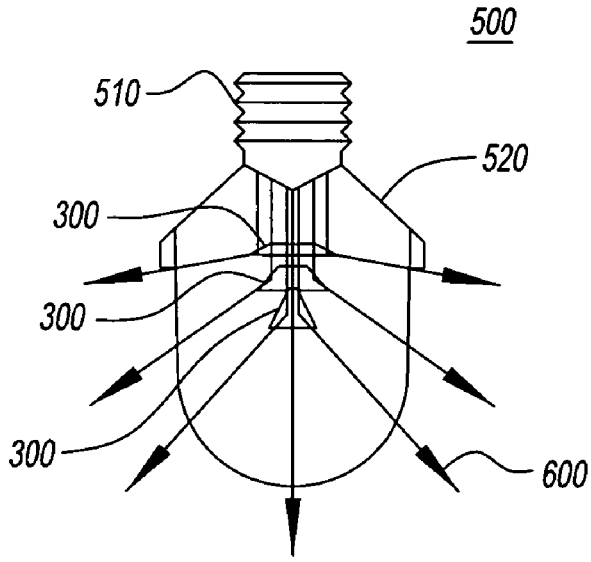
FIG. 1 shows the present invention as a bulb 500 in a side view.

The preferred embodiments of the present invention will now be described with reference to the drawings. Identical elements in the various figures are identified with the same reference numerals.

FIG. 1 shows the present invention as a bulb 500 in a side view. The invention is shown with a bulb 500, a bulb base 510, a plurality of beveled washers 300 and light beams 600. In this embodiment, light beams 600 are shown that are emitted by an LED that is inside the bulb base 510. Also seen is optional bulb casing 520.

The present invention is intended to primarily replace incandescent and florescent lamps for area lighting, but the principles herein can also be applied to other lighting schemes and applications. The types of point sources of light include but are not limited to: LEDs, organic LED (OLED), polymer LED (PLED), LASER, LASER diodes. The point light source may be replaceable. The point source of light is preferably an LED. Types of LEDs especially useful for the invention are high power LEDs, (HPLED) and high brightness LEDs which have an output of greater than 1 watt, and can be driven at 350 milliamperes of current or more. While a converter may be necessary, some LEDs have been developed that can run directly from main power, and may have an efficiency of from 10 to 150 lm/W. In other applications, the LED source may be a miniature LED having a size between 2 to 15 mm. They could be low current to high current and low to high output, typically rated for 2 to 30 mA at 2 to 5V.

Since LEDs by their nature generate large amounts of heat, a heat sink may be desirable in some applications.

The LEDs of the present invention can be any color, but the preferred color is white. The white light can be produced using any system now available or available in the future. For example, white light can be created using a RGB system, otherwise known as a multi-colored white LED where red, green, and blue LEDs are combined to create a white light. Another source of white light are phosphor based LEDs, where an LED, usually blue, is coated with phosphor of different colors to create white light. It should be noted that such phosphorus or phosphor based compounds is a common name for compounds that usually contain other components, such that light waves striking the compound of one color can be converted to many other colors. These systems tend to be less efficient than the RGB systems, but are alternatively simpler to construct and operate.

LED and other light sources may have color ranges that are not acceptable to the application. Some light sources which might provide efficient or high power light could contain unwanted color temperatures and be deemed un-useful for the application. This color could be converted by the light fixture using materials that convert the light to a different color. The application of such materials are well known, such as phosphorus that is widely used in fluorescent light sources. By utilization various concentrations of materials such as phosphorous, various colors of resulting light can be realized.

Alternatively, some light sources may consist of separate colors, such as red, blue or green. The combining of such sources can create a specific color temperature of the resulting light. For example, phosphorous can be disposed on the reflective means and the phosphorous converts the light beam to a different color. Also the light source can be comprised of separate multi colored light sources, and the separate multi colored light sources combine to provide a specific color though fixed or variable mixing. By using various filtering and/or refraction techniques, a light fixture can be created to properly mix these color sources into the desired resulting color.

Other types of LEDs useful for the present invention include organic light-emitting diodes (OLEDs). If the emitting layer material of the LED is an organic compound, it is known as an Organic Light Emitting Diode (OLED). To function as a semiconductor, the organic emitting material must have conjugated pi bonds. The emitting material can be a small organic molecule in a crystalline phase, or a polymer. By "light beam" it is meant a light beam originating from a point source, wherein the emits is less than 360 degrees, preferably less than 180 degrees, more preferably less than 120 and most preferably between 10 and 1 degrees. As used herein, the term LED can mean a single LED or multiple LEDs.

Figure 2A:
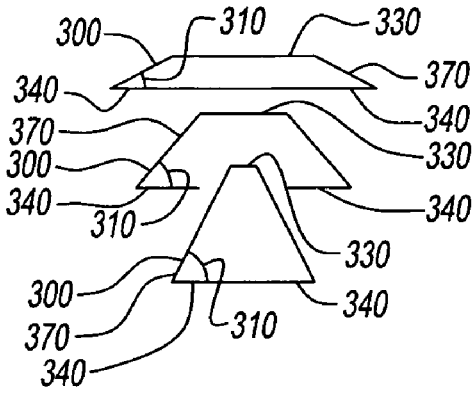
FIG. 2*a* shows a detail side-view of the beveled washers.
Figure 2B:
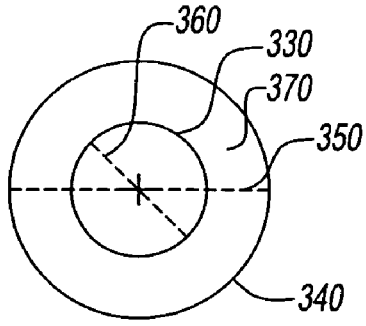
FIG. 2*b* shows a bottom detailed view of the beveled washers of FIG. 2*a*.

FIG. 2*a* shows a detail side view of the beveled washers 300 in FIG. 1, and FIG. 2*b* shows a top view of a beveled washer 300. The light beams 600 are shown interacting with the beveled washers 300. The beveled washers 300 are preferably in perpendicular orientation to the light beam, but in some embodiments could be oriented or skewed at an angle. As seen in FIG. 2*a*, the various beveled washers 300 each have a bevel hole diameter 360 which is defined by top edge 330. Similarly, the beveled washers have a bottom edge 340 which defines the overall washer diameter 350. The beveled washer has a bevel angle 310 which is defined the wall 370 of the beveled washer 300 and the plane defined by the bottom edge 340 of the beveled washer 300. The beveled washers 300 are shown as having top edges of various sizes and bevel angles, which create differing overall washer diameters 350, with larger overall washer diameters 350 near the point light source and smaller overall washer diameters 350 farther from the point source. Similarly, the bevel hole diameter 360 for each bevel washer 300 increases with the overall washer diameter 350. The number of beveled washers 300 can range from 2 to up 10. Preferably, the bevel angel 310 between horizontal piece and the angled piece is from 10 to 80, and the bevel angle 310 will become progressively more acute with each individual beveled washer 300. The bulb has at least two beveled washers 300, but can have any number of washers up to 10. The beveled washers 300 as shown in the drawings are circular, but could be other shapes such as rectangular, elliptical, square, etc. While the beveled washers 300 are shown as solid surfaces, they could be textured or patterned. The beveled washer 300, or the horizontal piece 330 or angled piece 340 could also have a semi-circular configuration or have portions cut away to create different diffusion patterns. The beveled washers 300 can be positioned relative to the LED with wire or other means.

In addition, FIGS. 1 and 2 also show optional protective bulb casing 520. The optional protective casing 520 can be any material, such as plastic or glass. It can be transparent or translucent, or coated with a luminescent material. In certain applications in may be desirable to have at least part of the cover coated with an opaque or reflective material.

In FIG. 1, light beams 600 from LED 200 are shown passing through the first beveled washer 300 where some of the light beam 600 is shown reflected to the side by the bevel washer 300. The remainder of the light beam 600 is shown passing through the hole 320 and continues to the next beveled washer 300 and thus only a portion of the light beam is reflected by the bevel washer 300. The remainder of the beam travels to the next beveled washer 300, where a portion is reflected, and the remainder travels to the next beveled washer in a similar manner. The general process as described above repeats as necessary, based on the number of beveled washers 300, and creates a diffusion pattern similar to incandescent lighting. The bottom two beveled washers 300 shown in FIG. 1 and FIG. 2 may then repeat the process of reflection and transmission. The beveled washers may be of any material such as Alzak aluminum, mirror material, multi-facet mirror material, translucent acrylic, and translucent acrylic with reflecting particles. Likewise, beveled washers may have one or both sides covered with reflective material.

Preferred sizes for the beveled washers 300 will vary depending on its location relative to the LED, but can be from ½ inch to 6 inches in diameter. The spacing between the horizontal piece of multiple beveled washers can also vary from 1 to 4 inches. The beveled washers can be equidistantly spaced or spaced at varying intervals to create different diffusion patters. In addition, the bevel angle 310 could also be adjustable, for example, by using a bendable material for the bevel washers 300 or with a hinge mechanism that adjusts the bevel angle with a window/shutter type mechanism.

The bulb casing 520 can be disposable or reusable, allowing replacement of just the LED. The bulb base 510 can any size, and is preferably can be placed in ordinary light sockets.

Figure 3:
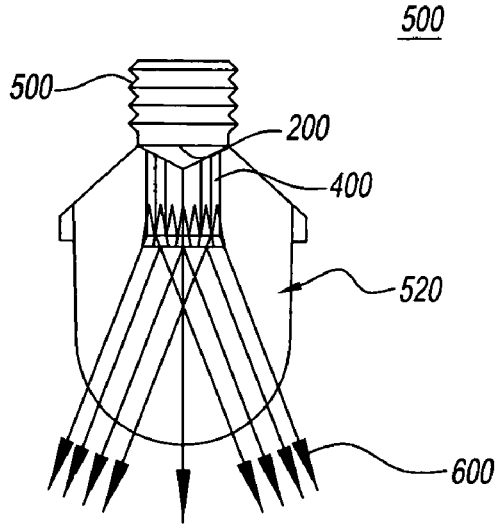
FIG. 3 shows the present invention as a bulb 500 in a side view.
Figure 4:
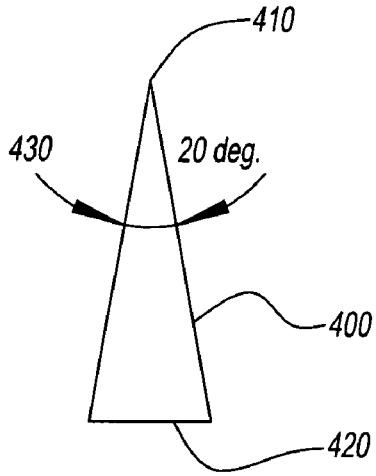
FIG. 4 shows a close-up view of the cone shaped reflector 400 in FIG. 3.

FIGS. 3 and 4 show an alternate embodiment of the invention which relies on a plurality of cone shaped reflectors 400 to diffuse the light beams 600 from LED 200. Optional bulb 500 has base 510 which maintains the bulb casing 520 and LED 200. The bulb 500 has at least one cone shaped reflector 400, and preferably three or more reflector cones. The cone shaped reflectors 400 can be attached at cone tip 410, to the base 500, to the LED 200 or affixed over the LED by a separate support structure. The cone shaped reflectors 400 can be made of any type of material, metal or plastic, including but not limited to Alzak aluminum, mirror material, multi-facet mirror material, translucent acrylic, and translucent acrylic with reflecting particles. Part or the entire cone surface can be reflective.

FIG. 4 is a detailed view of a cone shaped reflector 400, showing cone tip 410, cone base 420, The cone shaped reflector 400 has a cone angle 430, shown in the drawing at 20 degrees, but could vary from 5 to 85 degrees. As seen in FIG. 4, the cone shaped reflector 400 is a true cone, but the cone shaped reflectors could be other shapes as well, including pyramidal or multi-faceted. The surface of the cone shaped reflectors 400 could be patterned or smooth and the cones themselves can solid or hollow, or could have material removed to allow light diffusion therethrough, creating different diffusion patterns. The cone base 420 can have any diameter base.

Figure 5:
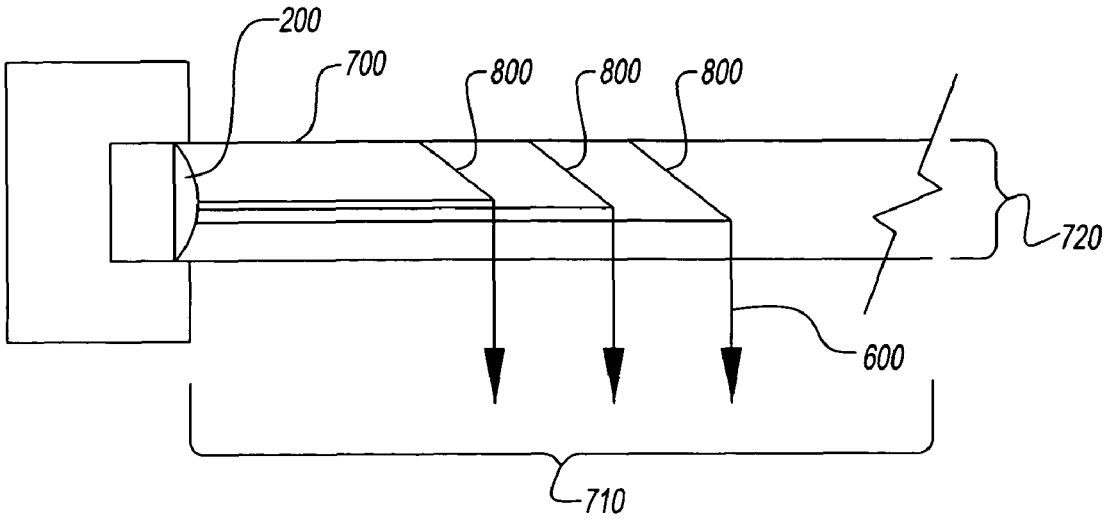
FIG. 5 shows the present invention as a tube 700 in a partial side view.

FIG. 5 shows an alternate embodiment of the invention as a tube 700 in a partial side view. The invention is shown with an LED 200, a tube 700, and reflectors 800. The tube 700 is shown with length 710 and a width 720 and a tube end 740. The tube 700 is shown with LED 200 and the tube end 740 attached to the end of the tube 700. The reflectors 800 are shown attached to the top of the tube 700 at an angle. Each reflector may have a different angle, which may be adjustable. The reflectors 800 may be of different sizes depending on the distance from the LED 200. The light beams 600 are shown being emitted by the LED 200 and are shown being reflected downward by the reflectors 800. The reflectors could also be beveled washers as described above.

Figure 6:
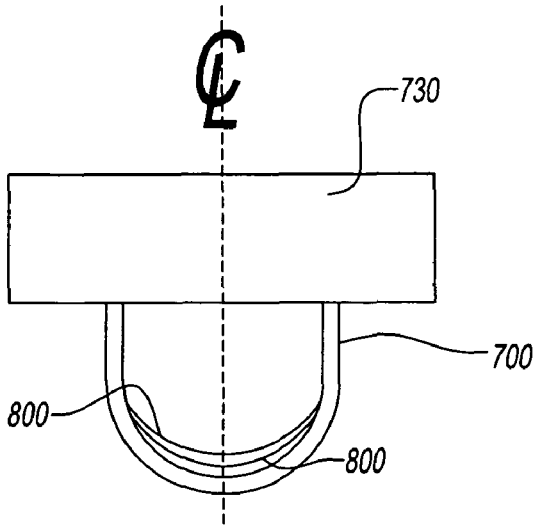
FIG. 6 shows the present invention as a tube 700 in an end cross-section view.

FIG. 6 shows the present invention as a tube 700 in an end cross-section view. The invention is shown with a tube 700, tube support rack 730, and reflectors 800. The invention is shown with the tube 700 and reflectors 800 attached to the tube support rack 730.

The invention is an article of manufacture, comprising: at least one point source of light which emits a light beam; and at least one reflective means for diffusing the light. The reflective means may be constructed from many materials including but not limited to: Alzak aluminum, mirror material, multi-facet mirror material, translucent acrylic, and translucent acrylic with reflecting particles. Any type of reflective means may only reflect a portion of the light or reflect in multiple directions. The reflective means may be adjusted to adjust the light diffusion.

In one of the preferred embodiments the point light source and the reflective means are contained in a bulb 500. A bulb 500 may be constructed from many materials including but not limited to: clear glass, frost glass, acrylic, plastic, and composites. In this embodiment the reflective means includes but is not limited to one or more of the following types: beveled washer 300, cone shaped reflector 400 and quadrilateral reflector. In this embodiment the reflective means may be at least one beveled washer 300 or a plurality of beveled washers 300. A beveled washer 300 may be perpendicular to the light beam 600. The reflective means may be at least one cone shaped reflector 400 or a plurality of cone shaped reflectors 400. A beveled washer 300 may have a bevel angle 310 and a hole 320. A beveled washer 300 may have a different bevel angle 310 from other beveled washers 300.

In additional preferred embodiments the point light source and the reflective means are contained in a tube 700. A tube 700 may be constructed from many materials including but not limited to: clear glass, frost glass, acrylic, plastic, and composites. The tube 700 may have a length 710 and a width 720 and the width may have a circular shape or semi-circular shape. The length 710 may be any length, but is preferably from ½ inch to 15 feet. The tube could be in the shape of bulb, with a neck and bulb area attached. The width 720 may be from ⅛ inch to 12 inches. In this preferred embodiment the reflective means may include but is not limited to: beveled washers, cone reflectors and quadrilateral reflectors. The reflective means may have an angle relative to axis of the tube 700, which may be adjustable. In this preferred embodiment the reflective means may be a plurality of reflectors in the shape of a beveled washer in perpendicular orientation to the light beam and the reflectors are located along the length of the tube.

Figure 7:
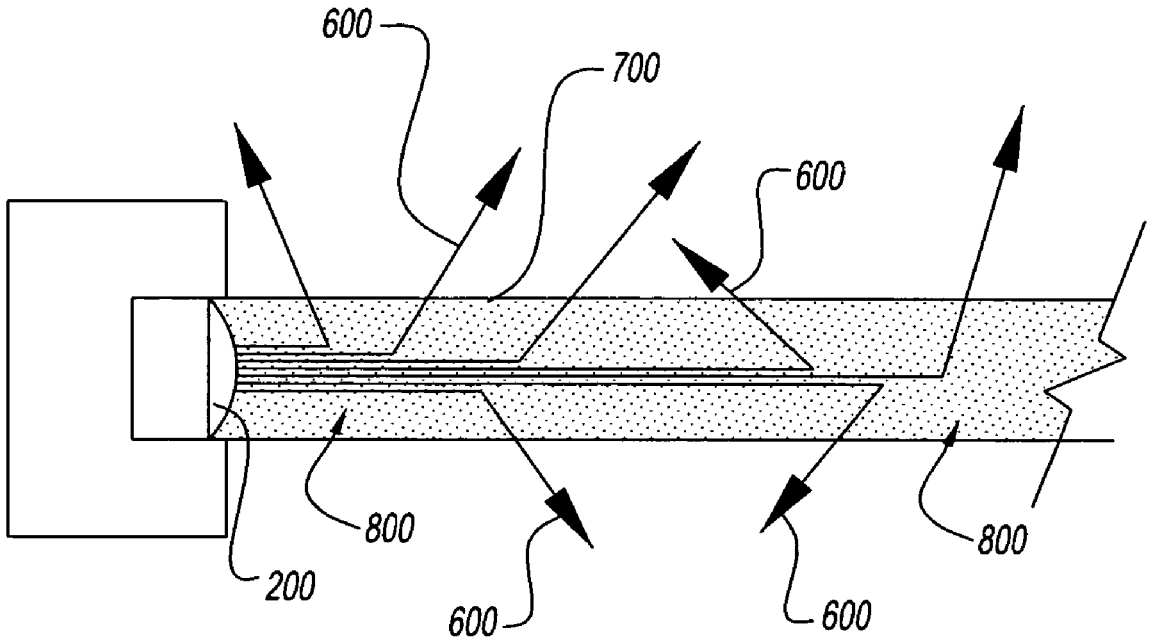
FIG. 7 shows a cross-sectional view of the tube 700 containing a suspension of light reflecting particles.

FIG. 7 illustrates an additional preferred embodiment, where the point source of light and the reflective means may be contained in a bulb 500 (not shown) or tube 700 and the tube or bulb may contain a suspension of light reflecting particles 800. Such a suspension 800 may be in a liquid phase or it can begin in the liquid phase and the particles cured in place by exposing the liquid to a curing medium such as ultraviolet radiation or heat. The medium should be clear or translucent and can be, for example, plastic or plastic resin, starch etc. The light particles may be oriented prior to curing. The orientation may be achieved by either mechanical means or electromagnetic means. The particles in such a suspension may be translucent or opaque, and can be made from any of the materials described herein, and may disperse light in one or many directions, and may be of a variant gradient. Further, the light reflecting particles may be fixed, left in suspension and mobile, or forced into motion by heat or mechanical means, including a motor, induced current, magnetic or other means to force the particle into motion thereby dispersing light in many directions to achieve a wider dispersion of light or other desired effects. In further embodiments the tube could also be constructed from a large diameter fiber in which the construction has a variable gradient which allows light to be dispersed through the fiber walls. Also demonstrated in FIG. 7 are light beams 600 from LED 200, traversing light reflecting particles 800. A reflector may be used in combination with light reflecting particles 800 to transport or disperse the light beams 600.

Figure 8A:
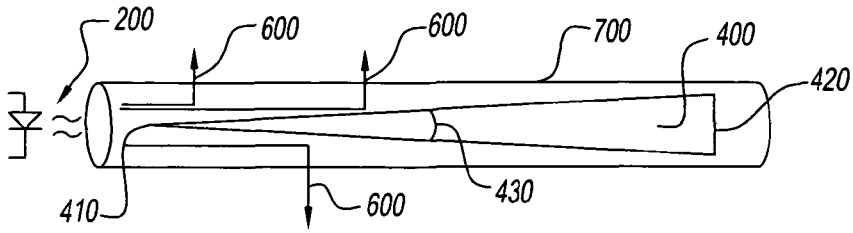
FIGS. 8A-8E show cross-sectional views of various embodiments of tubes 700 having internal reflectors 400.
Figure 8B:
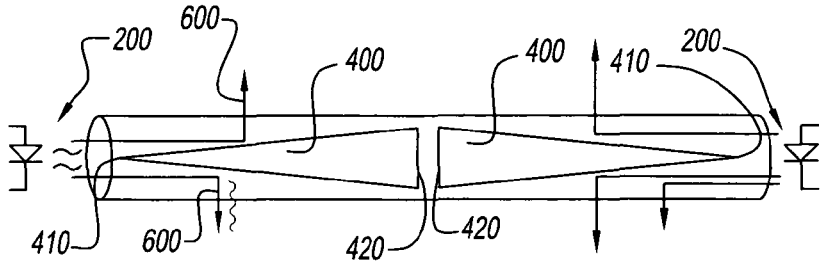
Figure 8C:
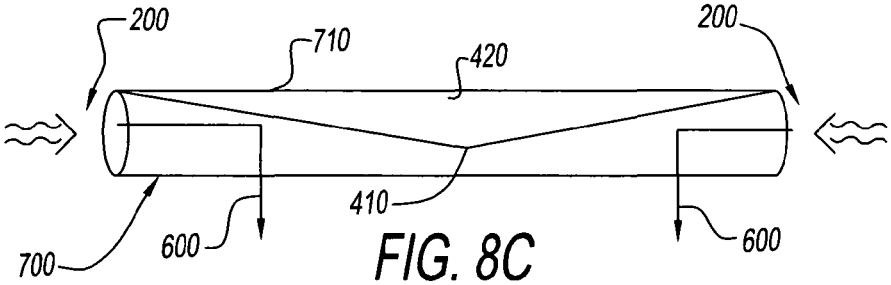

FIGS. 8*a*-8*c* show cross-sectional views of various embodiments of tubes 700 having internal reflectors 400. Also shown are cone shaped reflector 400, a reflector base 420, a reflector tip 410, a tube 700, light beams 600, angle 430, and LED 200. The LED 200 shows the source of light. The tube could contain a reflector system as earlier described with cones distributed throughout the tube. The reflectors may be cone shaped 400 (FIGS. 8*a*-8*d*), or the reflectors may be bulb shaped (FIG. 8*e*). In a further construction, the tube 700 may contain a light guide, which can direct the light down the tube, restrict the light or otherwise direct the light using various means inclusive of being coated with reflective material, phosphorus compounds, or variable optical refraction index means. Such restrictive means has the advantage of providing light in the intended direction which further increases the efficacy of the lighting system and advantageously provides more light for a given area. The reflectors 800 or beveled washers 300 (FIG. 1) may function as light guides and may be in a shape of a cone or may be planar. There may be one or several light guides running down the center, or along the sides of the tube 700 or a bulb 500. The reflectors 800 may have different shapes depending on an intended light output goal. In another alternative, a percentage of the tube's inner surface may be coated with reflective materials, particles, or phosphorous compounds.

FIG. 8*a* shows a cone shaped reflector 400. The light source 200 sends light beams 600 toward the tip 410. The reflector 400 is coated with reflective substances and is therefore capable of dispersing light beams in the direction shown.

FIG. 8*b* illustrates another embodiment of the tube 700 containing two cone shaped reflectors that are oriented with bases 420 facing each other. A light source 200 is now on both ends of the tube 700, as shown. The bases 420 may or may not be translucent, so as to be able to exchange light beams 600 between each other.

FIG. 8*c* illustrates a reflector 400, having a broad base 420 abutting a sidewall 710 of the tube 700. There are light sources 200 on both ends of the tube 700. The reflector disperses light beams 600 in the direction shown.

Figure 8D:
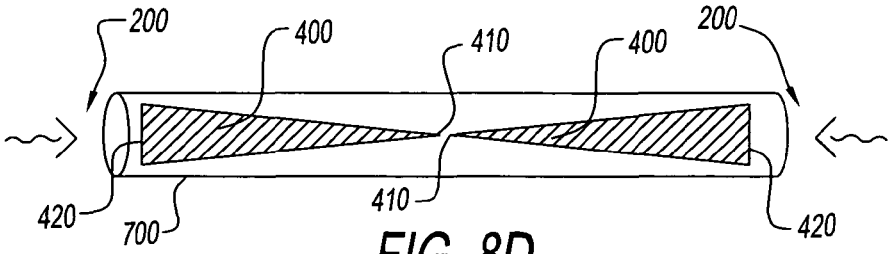
Figure 8E:
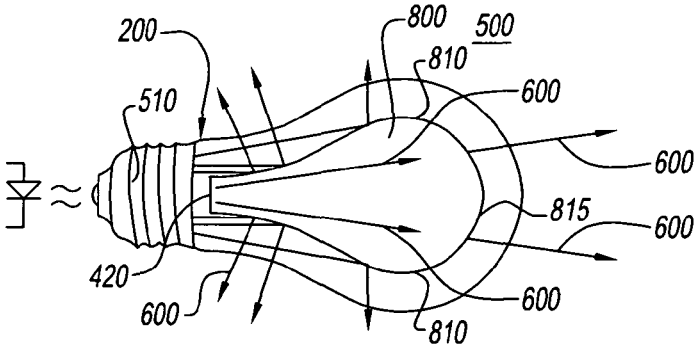

FIG. 8*d* illustrate cone shaped reflectors 400 that may be translucent and be able to guide light beams 600 in a particular way. The reflectors 400 are oriented with tips 410 facing each other. However, multiple orientation and number of reflectors 400 is intended.

The embodiment in FIG. 8*e* differs from the embodiment in FIG. 1, in that a reflector 800 is used instead of beveled washers 300. The light source or LED 200 is contained in the base 510. The reflector 800 preferably contains a reflective coating on its sides 810 to disperse light in the directions shown. Additionally, the base 420, and the rest of the reflector 800 is clear or translucent, thus enabling light beams 600 to shine from the frontal section 815. Such a reflector 800 may be used in the bulb 500 or the tube 700. All reflectors 800 or 400 may be suspended within a liquid phase, molded into a solid tube 700 or bulb 500, or mounted on a sidewall.

The invention can be used in a wide variety of applications for general residential and commercial lighting, but can also be used in smaller applications such as lamps, lanterns, flashlights, etc.

Although this invention has been described with a certain degree of particularity, it is to be understood that the present disclosure has been made only by way of illustration and that numerous changes in the details of construction and arrangement of parts may be resorted to without departing from the spirit and the scope of the invention.

We claim:

1. An article of manufacture, comprising:

at least one point source of light which emits an initial light beam having a beam divergence of less than or equal to 10 degrees about an axis of emission; and at least one apparatus for diffusing the light, said diffusing apparatus comprising:

a first beveled washer, oriented with a first washer-base substantially perpendicular to said light beam and having a reflective surface beveled at a first bevel angle with respect to said first washer-base, said beveled, reflecting surface being positioned between said first washer-base and said point source of light such that the beveled, reflective surface reflects an outer portion of said light beam away from said axis of emission but with a component of direction in the direction of said initial light beam, and wherein said first beveled washer has a hole with a center substantially aligned to said axis of emission, such that a central portion of said light beam passes through said first beveled washer unimpeded; and a second beveled washer oriented with a second washer-base substantially perpendicular to said light beam and having a reflective surface beveled at a second bevel angle with respect to said second washer-base, said second bevel angle being substantially larger than said first beveled angle, said beveled, reflected surface being positioned between said second washer-base and said first beveled washer such that the beveled, reflective surface reflects a portion of said light beam away from said axis of emission but with a component of direction in the direction of said initial light beam, and wherein said second washer has a hole with a center substantially aligned to said axis of emission, such that a central portion of said light beam passes through said second beveled washer unimpeded.

2. The article of claim 1, wherein the point source of light is an LED.

3. The article of claim 2, wherein the point source of light and the reflective means are contained in a bulb.

4. The article of claim 3, wherein the reflective means is at least one cone shaped reflector.

5. The article of claim 3, wherein the reflective means is a plurality of cone shaped reflectors.

6. The article of claim 5, wherein each reflector only reflects a portion of the light beam.

7. The article of claim 1, wherein the reflective means can be adjusted to adjust the light diffusion.

8. The article of claim 1, wherein the point source of light is replaceable.

9. The article of claim 2, wherein the point source of light and the reflective means are contained in a tube.

10. The article of claim 9, wherein the tube has a length and a width, and the width has a circular shape or a semi-circular shape.

11. The article of claim 1, wherein the point source of light and the reflective means are contained in a bulb or tube, and the tube or bulb contains a suspension of light reflecting or converting particles such as those coated with a phosphorus compound.

12. The article of claim 11, wherein the suspension is in a liquid phase which can be cured and the light reflecting particles are oriented prior to curing.

13. The article of claim 12, wherein the light reflecting particles are oriented with an electromagnetic field.

14. The article of claim 12, wherein the light reflecting particles are oriented mechanically.

15. The article of claim 11, wherein the light reflecting particle is translucent and disperses light at least two directions.

16. The article of claim 9, wherein the tube is a fiber having a variable gradient.

17. The article of claim 11, wherein the suspension can be moved by heat or other external force.

18. The article of claim 1, wherein phosphorous is disposed on the reflective means and the phosphorous converts the light beam to a different color.

19. The article of claim 1, wherein the light source is comprised of separate multi colored light sources, and the separate multi colored light sources combine to provide a specific color though fixed or variable mixing.

* * * * *